US011751636B2

(12) United States Patent
Wang et al.

(10) Patent No.: US 11,751,636 B2
(45) Date of Patent: Sep. 12, 2023

(54) ROTARY PUSH-PULL ROPE RETRACTOR AND SHOE

(71) Applicants: SHISHI SENKE INTELLIGENT TECHNOLOGY CO., LTD., Quanzhou (CN); Dongguan Yichuang Information Technology Co., Ltd., Dongguan (CN)

(72) Inventors: Shanpao Wang, Quanzhou (CN); Wendong Li, Dongguan (CN); Hongchao Li, Dongguan (CN); Chaoqun Hong, Quanzhou (CN); Jinlong Cai, Quanzhou (CN); Kunliang Tan, Quanzhou (CN); Shaofeng Chen, Quanzhou (CN); Jianming Cai, Quanzhou (CN); Weidong Xu, Quanzhou (CN)

(73) Assignees: Shishi Senke Intelligent Technology Co., Ltd., Quanzhou (CN); Dongguan Yichuang Information Technology Co., Ltd., Dongguan (CN)

( * ) Notice: Subject to any disclaimer, the term of this patent is extended or adjusted under 35 U.S.C. 154(b) by 0 days.

(21) Appl. No.: 17/721,303

(22) Filed: Apr. 14, 2022

(65) Prior Publication Data

US 2023/0014996 A1 Jan. 19, 2023

Related U.S. Application Data

(63) Continuation of application No. PCT/CN2022/076649, filed on Feb. 17, 2022.

(30) Foreign Application Priority Data

Jul. 19, 2021 (CN) ..... 202121642700.2

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/146; A43C 11/14; B65H 75/4452; Y10T 24/2183; Y10T 24/3724
See application file for complete search history.

(56) References Cited

U.S. PATENT DOCUMENTS 8,516,662 B2 * 8/2013 Goodman ..... B65H 75/4431 36/50.5
9,072,341 B2 * 7/2015 Jungkind ..... A43C 11/165
(Continued)

FOREIGN PATENT DOCUMENTS

CN 212260687 U 1/2021

OTHER PUBLICATIONS

Communication pursuant to Rules 70(2) and 70a(2) EPC of EP application No. 22706723.8 dated Sep. 12, 2022.
(Continued)

*Primary Examiner* — Robert Sandy
*Assistant Examiner* — Rowland Do
(74) *Attorney, Agent, or Firm* — Andrew C. Cheng

(57) ABSTRACT

A rotary push-pull rope retractor includes a top cover, a follower, a seat, a control member and a base. The seat is fixedly installed on the base. An upper surface of the seat is provided with an elastic member and a pawl connected with the elastic member. The follower includes a ratchet and a rope bin. The pawl is located on one side of the ratchet and engaged with the ratchet. The control member is slidably arranged on the upper surface of the seat, and the control member can push the pawl to move away from the ratchet and compress the elastic member to separate the pawl from
(Continued)

the ratchet, so as to switch the meshing mode or the free mode of the rotary push-pull rope retractor. The top cover is arranged above the seat, and the top cover and the follower are connected in linkage.

15 Claims, 3 Drawing Sheets

(56) References Cited

U.S. PATENT DOCUMENTS

| | | | | |
|---|---|---|---|---|
| 9,408,438 | B2 * | 8/2016 | Chen | A43C 11/20 |
| 9,635,906 | B2 * | 5/2017 | Midorikawa | A43C 11/165 |
| 10,368,613 | B2 * | 8/2019 | Ha | A43C 7/00 |
| 10,993,504 | B1 * | 5/2021 | Li | A43C 11/165 |
| 2013/0025100 | A1 * | 1/2013 | Ha | A43C 11/165 24/712.9 |
| 2017/0303643 | A1 * | 10/2017 | Converse | A61C 7/026 |
| 2019/0144150 | A1 * | 5/2019 | Chen | A43C 11/165 100/32 |
| 2020/0069002 | A1 * | 3/2020 | Fiedler | A44B 99/00 |
| 2021/0186159 | A1 * | 6/2021 | Hu | A43C 1/06 |
| 2021/0227937 | A1 * | 7/2021 | Hu | A43C 7/08 |
| 2021/0251343 | A1 * | 8/2021 | Martin | F16H 3/70 |
| 2021/0269275 | A1 * | 9/2021 | Kim | B65H 54/02 |
| 2021/0401121 | A1 * | 12/2021 | Kim | A41F 1/00 |
| 2022/0142304 | A1 * | 5/2022 | Chen | B65H 75/4494 |
| 2022/0259003 | A1 * | 8/2022 | Ha | B65H 75/4492 |

OTHER PUBLICATIONS

The extended European search report of EP application No. 22706723.8 dated Nov. 22, 2022.

* cited by examiner

ROTARY PUSH-PULL ROPE RETRACTOR AND SHOE

CROSS-REFERENCE TO RELATED APPLICATION

This application is a continuation of International Patent Application No. PCT/CN2022/076649, which claims priority of China Patent Application No. 202121642700.2 filed on Jul. 19, 2021, which is incorporated herein by reference in its entirety.

TECHNICAL FIELD

The present application relates to the technical field of daily necessities, and in particular, to a rotary push-pull rope retractor and a shoe with the rotary push-pull rope retractor.

BACKGROUND

In daily life, fixing by ropes is a common fixing method used in shoes, medical protective equipment or other daily necessities. Take shoes as an example, when using sports shoes or canvas shoes, the usual shoelaces go through the rope holes on the shoes, and then fasten them with bows or other buckles. In the process of sports, the shoelaces are easy to loose. When walking on the road or there are many hand-held items, if the shoelaces are loose and they need to be fastened, it is even more inconvenient. Especially in sports, once the shoelaces are loosened, accidents are easy to happen.

At present, there are rotary push-pull rope retractors on the market, but the structures are complex, and the accessories are small and numerous, resulting in complex manufacturing process and unable to assemble quickly, high production cost, weak structural stability, high scrap rate, and poor use effect.

SUMMARY

In view of the above, an object of the present application is to provide a rotary push-pull rope retractor and a shoe, which can solve the inconvenience caused by the way of binding and knotting the shoelaces, and avoid the accidental loosening of the shoelaces in the process of movement.

The present application provides a rotary push-pull rope retractor, which includes a top cover, a follower, a seat, a control member and a base;

wherein the seat is fixedly installed on the base, an interior of the seat is provided with a receiving cavity, an upper surface of the seat is provided with an elastic member and a pawl connected with the elastic member;

the follower includes a ratchet and a rope bin, the ratchet and the rope bin are connected axially, the rope bin is received in the receiving cavity, the ratchet passes through the upper surface of the seat to be located above the upper surface of the seat, the pawl is located on one side of the ratchet and engaged with the ratchet;

the control member is slidably arranged on the upper surface of the seat, and the control member is configured for pushing the pawl to move away from the ratchet and compress the elastic member to separate the pawl from the ratchet, so as to switch a meshing mode or a free mode of the rotary push-pull rope retractor;

the top cover is arranged above the seat, the top cover and the follower are connected in linkage;

in the meshing mode, the pawl is engaged with the ratchet, and when the top cover rotates, the top cover drives the follower to rotate together unidirectionally;

in the free mode, the pawl is disengaged from the ratchet, and the follower can rotate freely.

Further, a periphery of the upper surface of the seat extends upward to form a retaining wall, the retaining wail is connected with the elastic member, and two ends of the elastic member are respectively connected with the retaining wall and the pawl.

Further, the elastic member is V-shaped.

Further, the control member is provided with a pushing portion, the control member uses the pushing portion to push the pawl to move away from the ratchet and compress the elastic member.

Further, an opening is provided in a middle of the control member for accommodating the ratchet and the pawl, two opposite inner walls of the opening are each provided with the pushing portion, and the pushing portions provided on the two opposite inner walls of the opening respectively abut against two ends of the pawl.

Further, two opposite outer walls of the opening are each provided with an elastic arm, a free end of the elastic arm is provided with a positioning rib, the number of the retaining wall is multiple, the elastic member is connected with one of the retaining walls, an inner wall of another retaining wall located adjacent to the elastic arm is provided with a positioning groove configured for matching with the positioning rib in the free mode, the positioning rib is stuck in the positioning groove.

Further, the number of the retaining wall is three, the three retaining walls are arranged at intervals along a circumferential direction of the seat, and the elastic member is connected with the middle retaining wall.

Further, the control member has a first end and an opposite second end, the first end and the second end respectively protrude laterally outward from two opposite sides of the seat, so as to facilitate the user to push the control member through the first end or the second end.

Further, a cross-sectional shape of teeth of the pawl is wedge-shaped, a shape of the teeth of the pawl matches a shape of teeth of the ratchet, and the pawl is unidirectionally engaged with the ratchet.

Further, a connecting rod is provided downward at the bottom of the top cover, and the connecting rod is non-circular; the ratchet is axially provided with a mounting hole for mounting the connecting rod, and a shape of the mounting hole matches a shape of the connecting rod.

Further, a locking portion is provided at a distal end of the connecting rod, and the connecting rod is locked in the follower through the locking portion.

Further, the base includes a bottom plate and a cylindrical part arranged on the bottom plate, the bottom plate and the cylindrical part form a half open space for installation and fixation of a lower end of the seat.

Further, the seat is provided with two rope holes for a rope to pass through, a side wall of the rope bin is provided with two rope grooves for the rope to pass through, and an interior of the rope bin is provided with a hollow cavity.

Further, the rotary push-pull rope retractor is adapted to be used on shoes to adjust the tightness of shoe ropes.

The present application further provides a shoe, wherein the shoe is provided with the above rotary push-pull rope retractor.

The beneficial effects of the present application are: the rotary push-pull rope retractor and shoes provided in this embodiment can control the meshing mode of the ratchet and pawl in the rotary push-pull rope retractor through the control member to control rope loosening and rope tightening. When switching to the meshing mode, the effect of tightening the rope can be achieved by rotating the top cover. When switching to the free mode, pulling the rope can drive the reverse rotation of the rope bin, so as to release the rope. The user can easily complete the process of tying and releasing the rope, and the operation is convenient and fast.

BRIEF DESCRIPTION OF THE DRAWINGS

Hereinafter, some specific embodiments of the present application will be described in detail in an exemplary but not restrictive manner with reference to the accompanying drawings. Those skilled in the art should understand that these drawings are not necessarily drawn to scale. In the drawings.

DETAILED DESCRIPTION OF PREFERRED EMBODIMENTS

Figure 1:
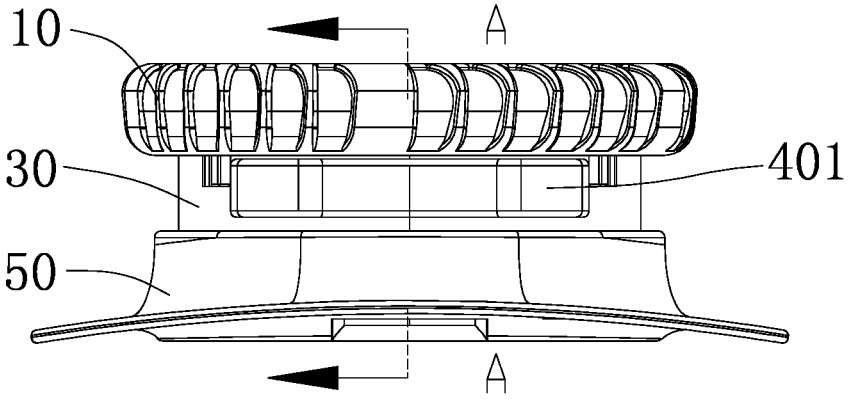
FIG. 1 is a front view of a rotary push-pull rope retractor according to an embodiment of the application.

The present application is further described in detail with reference to the following specific embodiments and the accompanying drawings. Obviously, the described embodiments are only part of the embodiments of the application, not all of the embodiments. Based on the embodiments in the application, all other embodiments obtained by ordinary technicians in the art without creative work belong to the scope of protection of the application.

In this application, unless otherwise specified and limited, the terms "installed", "connected", "fixed" and other terms shall be understood in a broad sense. For example, they can be fixed connection, removable connection, or integrated; it can be mechanical connection or electrical connection; it can be directly connected or indirectly connected through an intermediate medium; it can be the connection within two elements or the interaction relationship between two elements. For those skilled in the art, the specific meaning of the above terms in the application can be understood according to the specific circumstances.

It should be noted that in this application, relational terms such as "first", "second" or the like are only used to distinguish one entity or operation from another entity or operation, and do not necessarily require or imply any such actual relationship or order between these entities or operations.

Referring to FIGS. 1 to 4, in the embodiment provided by the application, the rotary push-pull rope retractor includes a top cover 10, a follower 20, a seat 30, a control member 40 and a base 50, wherein the seat 30 is fixedly installed on the base 50, the follower 20 is arranged in the seat 30, the top cover 10 is arranged above the seat 30, and the control member 40 is arranged between the top cover 10 and the seat 30 for the user to switch modes.

Specifically, the bottom of the top cover 10 is provided with a connecting rod 11 extending downward, and the connecting rod 11 is non-circular, for example, in this embodiment, the connecting rod 11 is in the shape of a multi prism. The follower 20 includes a ratchet 21 and a rope bin 22. A mounting hole 211 used for mounting the connecting rod 11 is axially provided in the ratchet 21. The shape of the mounting hole 211 matches the shape of the connecting rod 11, that is, the mounting hole 211 is also non-circular, for example, in this embodiment, the mounting hole 211 is also in the shape of a multi prism, such that after the connecting rod 11 of the top cover 10 is mounted into the mounting hole 211, the top cover 10 and the follower 20 are connected in linkage, that is, when the top cover 10 is rotated, the top cover 10 will drive the follower 20 to rotate together.

Further, a locking portion 12 is provided at the distal end of the connecting rod 11 so that the connecting rod 11 is locked in the mounting hole 211 of the follower 20, to ensure the stability of the connection between the top cover 10 and the follower 20 and prevent the top cover 10 from falling off from the follower 20 during use.

Specifically, the base 50 includes a bottom plate 51 and a cylindrical part 52 arranged on the bottom plate 51. The bottom plate 51 and the cylindrical part 52 form a half open space. The diameter of the seat 30 is slightly smaller than that of the cylindrical part 52. The lower end of the seat 30 is placed in the half open space and clamped on the base 50 to ensure the fixed connection between the seat 30 and the base 50. The base 50 is located at the bottom of the rotary push-pull rope retractor, and the periphery of the base plate 51 is used to sew on wearable objects (such as shoes). Preferably, the bottom plate 51 is made of synthetic fiber material, which can be sewn directly without additionally using other materials, and the fixation is simple and fast. Of course, other materials can also be selected for the bottom plate 51 according to actual use, and the present application does not limit the material of the base plate 51.

Figure 2:
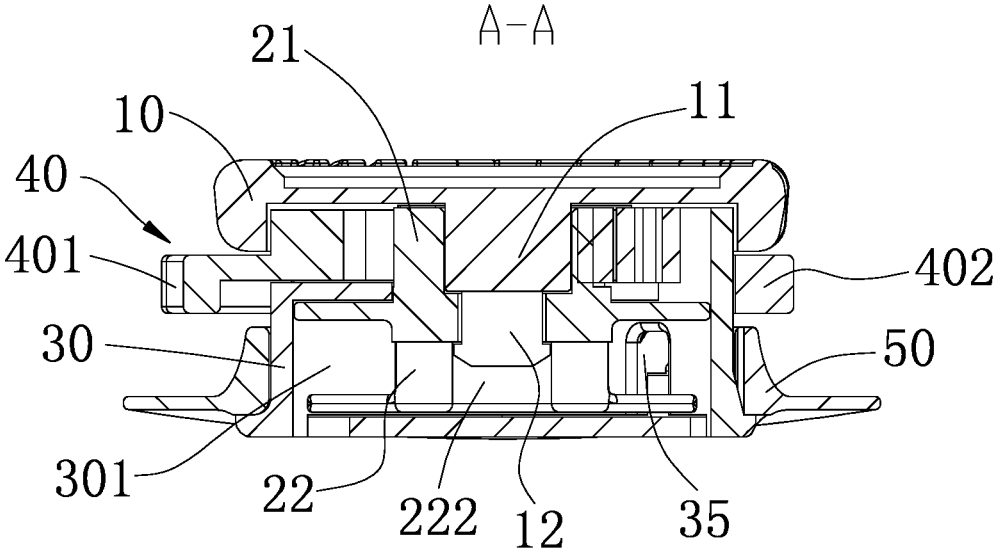
FIG. 2 is a cross-sectional view along A-A in FIG. 1.
Figure 3:
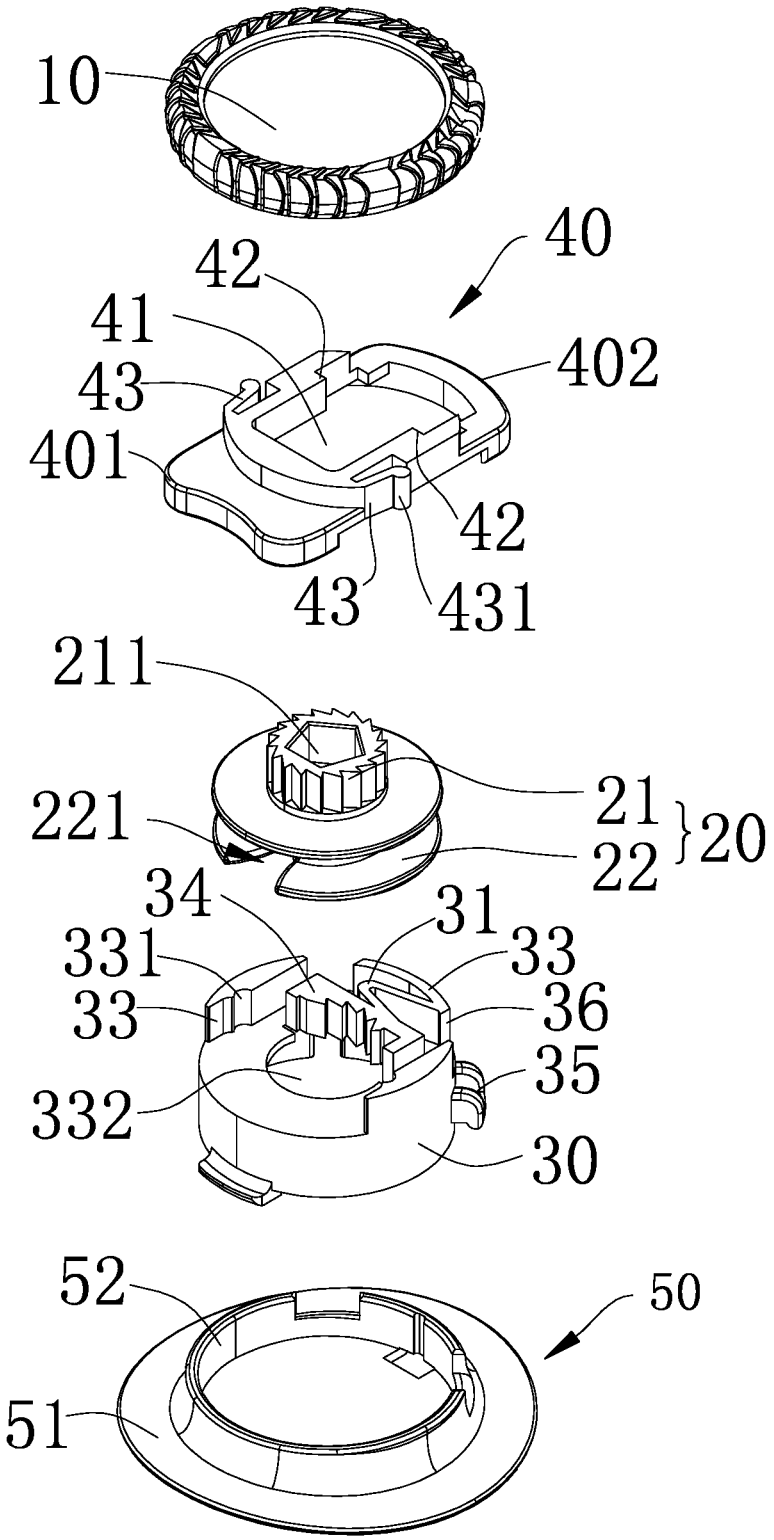
FIG. 3 is an exploded view of FIG. 1.
Figure 4:
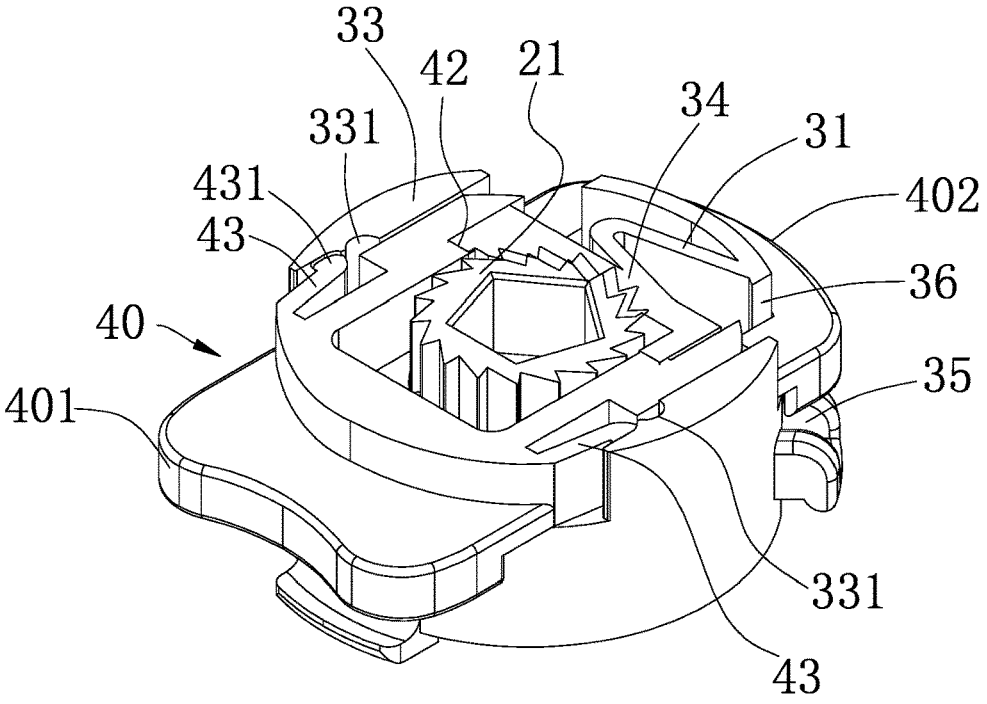
FIG. 4 is an assembled view of FIG. 3 by removing the top cover and the base.

The seat 30 is fixedly installed on the base 50. The interior of the seat 30 is provided with a receiving cavity 301 (FIG. 2). The upper surface of the seat 30 is provided with an elastic member 31 and a pawl 34 connected with the elastic member 31. Specifically, the periphery of the upper surface of the seat 30 extends upward to form a plurality of retaining walls 33. In this embodiment, three retaining walls 33 are provided on the upper surface of the seat 30, and the three retaining walls 33 are arranged at intervals along the circumferential direction of the seat 30. The inner wall of the middle retaining wall 33 is connected with the pawl 34 through the elastic member 31. One end of the elastic member 31 is connected with the middle retaining wall 33, and the other end of the elastic member 31 is connected with the pawl 34. The pawl 34 is located above the upper surface of the seat 30 and is located between the other two retaining walls 33. A notch 36 (FIG. 4) is formed between the middle retaining wall 33 and any one of the other two retaining walls 33, such that the control member 40 can slide back and forth on the upper surface of the seat 30 while passing through the notches 36.

The elastic member 31 may be plastic or metal. In order to facilitate production and improve assembly efficiency, the middle retaining wall 33 may be integrally connected with the elastic member 31 and the pawl 34. That is, the elastic member 31, the pawl 34 and the middle retaining wall 33 are integrally formed. Two ends of the elastic member 31 are respectively connected with the middle retaining wall 33 and the pawl 34. In this embodiment, the elastic member 31 is V-shaped. When the pawl 31 is pushed to move toward the middle retaining wall 33, the elastic member 31 is compressed by the pawl 34.

Specifically, the seat 30 is further provided with two rope holes 35 for the rope to pass through. Preferably, the rope holes 35 are arranged at the bottom of the seat 30, which is beautiful and easy to use.

The follower 20 includes a ratchet 21 and a rope bin 22. The ratchet 21 extends upward from the top of the rope bin 22 along the axial direction of the follower 20, such that the ratchet 21 and the rope bin 22 are connected axially into a whole, and therefore, the rope bin 22 rotates with the ratchet 21. Specifically, the ratchet 21 and the rope bin 22 are arranged coaxially. The rope bin 22 is received in the receiving cavity 301 of the seat 30, the middle of the upper surface of the seat 30 is provided with a through hole 332, and the ratchet 21 extends out from the through hole 332 to be located above the upper surface of the seat 30. The ratchet 21 is in the same plane with the pawl 34, and the pawl 34 is located on one side of the ratchet 21. The pawl 34 and the ratchet 21 can be in a meshing mode or a free mode. When the pawl 34 is engaged with the ratchet 21, the pawl 34 and the ratchet 21 are in the meshing mode; when the pawl 34 is disengaged from the ratchet 21, the pawl 34 and the ratchet 21 are in the free mode.

Specifically, in order to ensure that the rope tightening effect can be achieved in the meshing mode, the cross-sectional shape of teeth of the pawl 34 is =wedge-shaped, that is, the pawl 34 has biased triangular teeth, and the shape of the teeth of the pawl 34 matches the shape of teeth of the ratchet 21, so that the pawl 34 and the ratchet 21 are engaged in unidirectional engagement, that is, in the meshing mode of the pawl 34 and the ratchet 21, the rope can only rotate in the tightening direction and cannot rotate in a reverse direction.

The side wall of the rope bin 22 is provided with two rope grooves 221 for the rope to pass through. The interior of the rope bin 22 is provided with a hollow cavity 222. In actual use, the rope has two ends of head and tail. After the two ends of the head and the tail of the rope enter the rope bin 22 respectively from the two rope holes 35, the two ends of the head and the tail then enter the hollow cavity 222 inside the rope bin 22 respectively through the two rope grooves 221, and the two ends of the head and the tail are knotted to form a closed loop of the rope. Thus, when the rope bin 22 rotates forward, the rope is wound on the outer wall of the rope bin 22.

The control member 40 is slidably arranged on the upper surface of the seat 30, that is, the control member 40 can slide back and forth along the upper surface of the seat 30. The control member 40 is provided with a pushing portion 42, which can push the pawl 34 to move away from the ratchet 21 and compress the elastic member 31 to separate the pawl 34 from the ratchet 21, so as to switch the meshing mode or the free mode of the rotary push-pull rope retractor. In this embodiment, the control member 40 has a first end 401 and an opposite second end 402. The first end 401 and the second end 402 respectively protrude laterally outward from two opposite sides of the seat 30, so that the user can push the control member 40 to move through the first end 401 or the second end 402, and the control member 40 can move back and forth on the upper surface of the seat 30 by the external force given by the user, so as to control whether the pawl 34 is engaged with the ratchet 21. thereby achieving the purpose of switching modes.

An opening 41 is provided in the middle of the control member 40 for accommodating the ratchet 21 and the pawl 34. Two opposite inner walls of the opening 41 are each provided with a pushing portion 42. The pushing portions 42 provided on the two opposite inner walls of the opening 41 respectively abut against two ends of the pawl 34, so that the control member 40 can push the pawl 34 to move in the direction facing the second end 402 through the pushing portions 42 and compress the elastic member 31, so as to separate the pawl 34 from the ratchet 21. Therefore, the control member 40 can control the engagement or disengagement between the pawl 34 and the ratchet 21 to establish the meshing mode or the free mode.

Specifically, two opposite outer walls of the opening 41 are each provided with an elastic arm 43, and the free end of the elastic arm 43 is provided with a positioning rib 431. A positioning groove 331 matching the positioning rib 431 is provided on the inner wall of the corresponding retaining wall 33 located adjacent to the elastic arm 43. When the user pushes the control member 40 to move in the direction facing the second end 402, the pushing portions 42 abut against the two ends of the pawl 34, so that the control member 40 pushes the pawl 34 to move in the direction facing the second end 402 and compress the elastic member 31 to separate the pawl 34 from the ratchet 21. When the control member 40 moves to the position in which the positioning rib 431 falls in the positioning groove 331, the positioning rib 431 is limited in the positioning groove 331. At this time, the elastic member 31 is in the compressed state, and the pushing portion 42 has a reaction force exerted by the elastic member 31. However, since the positioning rib 431 is limited in the positioning groove 331, the control member 40 will not be easily displaced, and the control member 40 can be maintained in the free mode in which the pawl 34 is disengaged from the ratchet 21.

For convenience of description, when the control member 40 is pushed toward the first end 401, it is pushed to the left; and when the control member 40 is pushed toward the second end 401, it is pushed to the right. When the user needs to fasten the rope, the control member 40 is pushed to the left to make the control member 40 in the leftmost position, the elastic member 31 restores to its natural state to make the pawl 34 mesh with the ratchet 21. At this time, the rotary push-pull rope retractor is in the meshing mode, and in the meshing mode, the elastic member 31 applies pressure to the pawl 34 through its own elastic force, so that the pawl 34 is engaged and meshed with the ratchet 21. In this embodiment, it is assumed that the clockwise direction is the rope tightening direction. When the top cover 10 is rotated clockwise, the top cover 10 will drive the follower 20 to rotate together. In the process of rotation, the follower 20 drives the rope to wrap around the outer wall of the rope bin 22 to achieve the purpose of rope tightening. At the same time, in the meshing mode, the top cover 10 can only drive the follower 20 to rotate in the tightening direction, and the top cover 10 and the follower 20 cannot rotate in the reverse direction, so the purpose of rope tightening can be achieved.

When the user needs to loosen the rope, the control member 40 is pushed to the right, and the control member 40 pushes the pawl 34 to move and compress the elastic member 31 through the pushing portions 42, so that the pawl 34 is separated from the ratchet 21. At this time, the rotary push-pull rope retractor is switched to the free mode, and in the free mode, the follower 20 can rotate freely. When the positioning rib 431 of the elastic arm 43 is stuck in the positioning groove 331, the rotary push-pull rope retractor can be maintained in the free mode. When the user pulls the rope through external force, the rope can be pulled out, and the follower 20 is driven to rotate counterclockwise to achieve the effect of loosening the rope. When the rope is loosened to reach the required tightness, the control member 40 is pushed to the left to cause the positioning rib 431 to separate from the positioning groove 331, the elastic member 31 then applies pressure to the pawl 34 through its own elasticity, and the pawl 34 is pushed by the elastic member 31 to move toward the ratchet 21, so that the pawl 34 and the ratchet 21 enter the meshing mode again.

It should be noted that in other embodiments, the positioning rib 43 and the positioning groove 331 can also be omitted. At this time, if the force applied by the right push of the control member 40 is maintained, the rotary push-pull rope retractor can be maintained in the free mode. When the force applied by the right push of the control member 40 is removed, the pawl 34 is pushed by the elastic force of the elastic member 31, so that the pawl 34 and the ratchet 21 enter the meshing mode again.

In the above embodiment, the rotary push-pull rope retractor is used on wearable objects that need to be tied, such as shoes, medical protective equipment, etc. Preferably, the rotary push-pull rope retractor is suitable to be used on shoes to adjust the tightness of the shoe rope.

In this embodiment, it is assumed that the clockwise direction is the rope tightening direction, but it is not limited to this. In other embodiments, due to the different habits of people using left and right hands, the counterclockwise direction can also be set as the rope tightening direction, and in this case, it only needs to change the direction of the biased triangular teeth of the ratchet 21 and the pawl 34, so that the biased direction is opposite to the clockwise rope tightening direction. Other principles are the same as those in this embodiment and will not be repeated herein.

Figure 5:
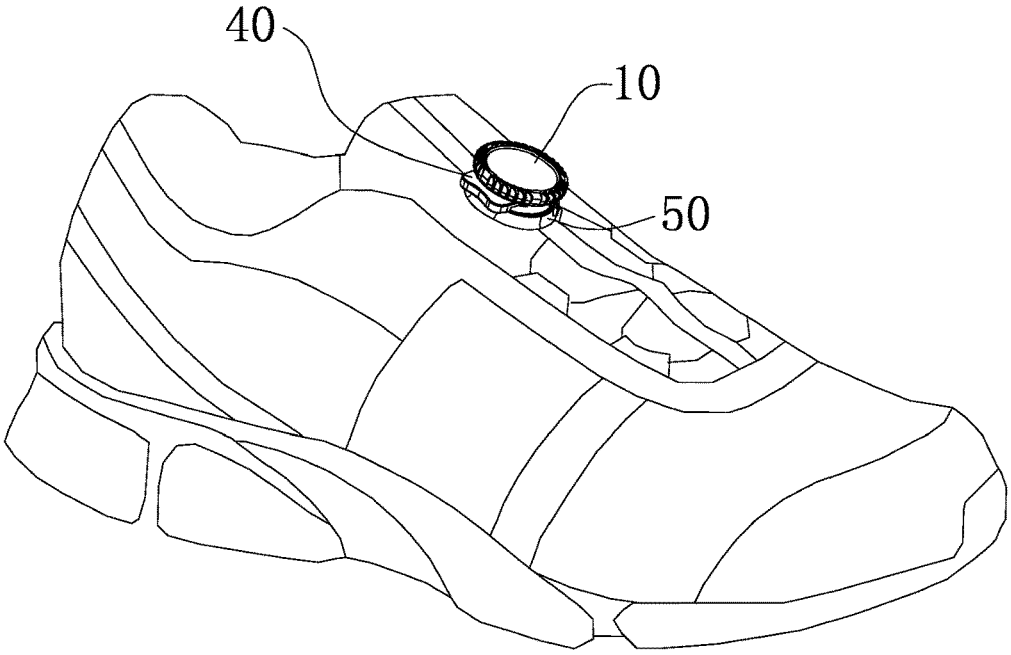
FIG. 5 is a structural diagram of a shoe with the rotary push-pull rope retractor according to the embodiment of the application.

Referring to FIG. 5, the embodiment of the present application further provides a shoe, which is provided with the above rotary push-pull rope retractor.

The above is only an embodiment of this application and not intended to limit this application. Any modification, equivalent replacement, improvement, etc. made within the spirit and principle of this application shall be included in the scope of protection of this application.

What is claimed is:

1. A rotary push-pull rope retractor comprising a top cover, a follower, a seat, a control member and a base;

wherein the seat is fixedly installed on the base, an interior of the seat is provided with a receiving cavity, an upper surface of the seat is provided with an elastic member and a pawl connected with the elastic member;

the follower comprises a ratchet and a rope bin, the ratchet and the rope bin are connected axially, the rope bin is received in the receiving cavity, the ratchet passes through the upper surface of the seat to be located above the upper surface of the seat, the pawl is located on one side of the ratchet and engaged with the ratchet;

the control member is slidably arranged on the upper surface of the seat, and the control member is configured for pushing the pawl to move away from the ratchet and compress the elastic member to separate the pawl from the ratchet, so as to switch a meshing mode or a free mode of the rotary push-pull rope retractor;

the top cover is arranged above the seat, the top cover and the follower are connected in linkage;

in the meshing mode, the pawl is engaged with the ratchet, and when the top cover rotates, the top cover drives the follower to rotate together unidirectionally;

in the free mode, the pawl is disengaged from the ratchet, and the follower can rotate freely.

2. The rotary push-pull rope retractor according to claim 1, wherein a periphery of the upper surface of the seat extends upward to form a retaining wall, the retaining wall is connected with the elastic member, and two ends of the elastic member are respectively connected with the retaining wall and the pawl.

3. The rotary push-pull rope retractor according to claim 2, wherein the elastic member is V-shaped.

4. The rotary push-pull rope retractor according to claim 2, wherein the control member is provided with a pushing portion, the control member uses the pushing portion to push the pawl to move away from the ratchet and compress the elastic member.

5. The rotary push-pull rope retractor according to claim 4, wherein an opening is provided in a middle of the control member for accommodating the ratchet and the pawl, two opposite inner walls of the opening are each provided with the pushing portion, and the pushing portions provided on the two opposite inner walls of the opening respectively abut against two ends of the pawl.

6. The rotary push-pull rope retractor according to claim 5, wherein two opposite outer walls of the opening are each provided with an elastic arm, a free end of the elastic arm is provided with a positioning rib, the number of the retaining wall is multiple, the elastic member is connected with one of the retaining walls, an inner wall of another retaining wall located adjacent to the elastic arm is provided with a positioning groove configured for matching with the positioning rib; in the free mode, the positioning rib is stuck in the positioning groove.

7. The rotary push-pull rope retractor according to claim 6, wherein the number of the retaining wall is three, the three retaining walls are arranged at intervals along a circumferential direction of the seat, and the elastic member is connected with the middle retaining wall.

8. The rotary push-pull rope retractor according to claim 1, wherein the control member has a first end and an opposite second end, the first end and the second end respectively protrude laterally outward from two opposite sides of the seat, so as to facilitate the user to push the control member through the first end or the second end.

9. The rotary push-pull rope retractor according to claim 1, wherein a cross-sectional shape of teeth of the pawl is wedge-shaped, a shape of the teeth of the pawl matches a shape of teeth of the ratchet, and the pawl is unidirectionally engaged with the ratchet.

10. The rotary push-pull rope retractor according to claim 1, wherein a connecting rod is provided downward at the bottom of the top cover, and the connecting rod is non-circular; the ratchet is axially provided with a mounting hole for mounting the connecting rod, and a shape of the mounting hole matches a shape of the connecting rod.

11. The rotary push-pull rope retractor according to claim 10, wherein a locking portion is provided at a distal end of the connecting rod, and the connecting rod is locked in the follower through the locking portion.

12. The rotary push-pull rope retractor according to claim 1, wherein the base comprises a bottom plate and a cylindrical part arranged on the bottom plate, the bottom plate and the cylindrical part form a half open space for installation and fixation of a lower end of the seat.

13. The rotary push-pull rope retractor according to claim 1, wherein the seat is provided with two rope holes for a rope to pass through, a side wall of the rope bin is provided with two rope grooves for the rope to pass through, and an interior of the rope bin is provided with a hollow cavity.

14. The rotary push-pull rope retractor according to claim 1, wherein the rotary push-pull rope retractor is adapted to be used on shoes to adjust the tightness of shoe ropes.

15. A shoe, wherein the shoe is provided with the rotary push-pull rope retractor according to claim 1.

* * * * *